US007530843B1

(12) United States Patent
Tesfay et al.

(10) Patent No.: US 7,530,843 B1
(45) Date of Patent: May 12, 2009

(54) SEALED ELECTRICAL TERMINAL

(75) Inventors: Semere T. Tesfay, Westland, MI (US); John J. Hasija, Saline, MI (US); Alexander J. Advey, Ypsilanti, MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 12/076,453

(22) Filed: Mar. 19, 2008

(51) Int. Cl.
*H01R 13/40* (2006.01)

(52) U.S. Cl. ..... 439/587; 439/855; 439/883; 439/921

(58) Field of Classification Search ..... 439/587, 439/801, 855, 860, 877, 881, 883, 921
See application file for complete search history.

(56) References Cited

U.S. PATENT DOCUMENTS

| | | | | |
|---|---|---|---|---|
| 3,842,390 | A | 10/1974 | Glover et al. | |
| 4,702,543 | A | 10/1987 | Hager | |
| 4,723,925 | A * | 2/1988 | Orr et al. | 439/877 |
| 4,969,841 | A * | 11/1990 | Sueyoshi et al. | 439/595 |
| 5,017,160 | A | 5/1991 | Garcia | |
| 5,667,413 | A | 9/1997 | Trafton | |
| 5,751,135 | A | 5/1998 | Fukushima et al. | |
| 6,059,594 | A * | 5/2000 | Davis et al. | 439/275 |
| 6,254,439 | B1 | 7/2001 | Endo et al. | |
| 6,309,225 | B2 | 10/2001 | Kameyama | |
| 6,540,568 | B2 | 4/2003 | Miyazaki | |
| 6,613,263 | B2 * | 9/2003 | Kondo | 264/263 |
| 6,875,063 | B2 | 4/2005 | Zhao et al. | |
| 7,070,449 | B2 * | 7/2006 | Miyazaki | 439/587 |
| 7,070,461 | B1 * | 7/2006 | Pavlovic et al. | 439/766 |
| 7,077,676 | B2 | 7/2006 | Matsumoto et al. | |
| 7,115,003 | B2 | 10/2006 | Zhao et al. | |
| 7,174,633 | B2 * | 2/2007 | Onuma | 29/854 |

FOREIGN PATENT DOCUMENTS

| | | | |
|---|---|---|---|
| EP | 0 553 872 | A1 | 8/1993 |

* cited by examiner

*Primary Examiner*—Thanh-Tam T Le
(74) *Attorney, Agent, or Firm*—Daniel R. Edelbrock

(57) ABSTRACT

An electrical terminal is sealed for use in high voltage vehicle systems. The terminal has a cylindrical section positioned between a contact section for mating with another electrical contact or terminal and a crimp section for mechanically and electrically securing the terminal to an electrical wire. The cylindrical section is integral with both the contact section and the crimp section, and includes an outer surface with a circumferential groove. The groove receives and retains an o-ring seal for preventing contaminant seepage between the contact section and the crimp section when the contact section is inserted into a connector for mating with the other contact or terminal. The contact section may be either a substantially flat eyelet contact, a male contact or female contact.

17 Claims, 6 Drawing Sheets

SEALED ELECTRICAL TERMINAL

BACKGROUND OF THE INVENTION

1. Field of the Invention

The invention is directed in general to an electrical terminal for use in high voltage systems and more specifically to a terminal with a feature for optimally locating and securely holding a seal in position.

2. Discussion of Related Art

FIG. 1 illustrates a typical male blade terminal 12 with a wire seal 14. The seal 14 is positioned in a notch or cutout 16 in the terminal just to the front of a terminal bond portion 18. The bond portion attaches an insulation-stripped end 20 of a conductive wire 22 to the terminal. The seal 14 is generally not reliably held in position and can shift into an inefficient position when the terminal 12 is inserted into a terminal accommodating chamber in a connector housing. Therefore, the seal may fail to prevent fluid seepage into the stripped end of the wire at the bond. The fluid could travel along the wire 22 interior to damage a connected power module or connector.

FIG. 2 shows another type of wire seal 24 often used with an electrical wire 26. The seal 24 is one piece and has a crimp portion 28. A blade terminal 30 is separate from the seal 24 and requires its own crimping process for attachment to a stripped end of the wire. The seal crimp portion 28 requires an additional crimp process to an insulation layer of the wire. The seal 24 is not attached to the blade terminal 30. It is positioned behind the blade terminal and a blade terminal crimp area 32. A lock 34 on the terminal secures the terminal in a terminal accommodating chamber within a connector. In this design, fluids can seep into the wire conductor strands at the blade terminal crimp location.

Charge connectors or couplers for electric vehicles, such as the one shown in U.S. Pat. No. 5,751,135, require high voltage terminals, and the terminals in both the power receiving and power supplying connector housings must be waterproofed. High voltage terminals specifically and reliably sealed to prevent water or other solid and fluid contaminants from seeping into the power supply wire or cable from electrical contact ends of the terminals would seem to beneficial in this and similar environments.

SUMMARY OF THE INVENTION

Accordingly, it is an object of this invention to provide a terminal designed to reliably hold a seal in a position between a contact section and a wire attachment section when it is inserted into a terminal accommodating chamber within a connector housing.

Another object of the invention is to make a separate retention feature for the seal on the terminal or within the connector housing unnecessary.

A further object of the invention is to eliminate the need for a seal crimp process to apply the seal on the terminal.

In carrying out this invention in the illustrative embodiment thereof, an electrical terminal is machined as one piece from an electrically conductive material. The terminal has a contact section for electrical engagement with a mating element such as a conductive surface or complementary terminal. The contact section extends from one end face of a cylindrical section having an outer circumferential surface. A crimp section extends from an opposite end face of the cylindrical section for mechanically and electrically joining the terminal to an electrical cable or wire. A groove extends around the outer circumferential surface of the cylindrical section. The groove is sized and configured to receive and retain an o-ring seal.

BRIEF DESCRIPTION OF THE DRAWINGS

This invention, together with other objects, features, aspects and advantages thereof, will be more clearly understood from the following description, considered in conjunction with the accompanying drawings.

DETAILED DESCRIPTION OF THE ILLUSTRATED EMBODIMENT

Figure 2:
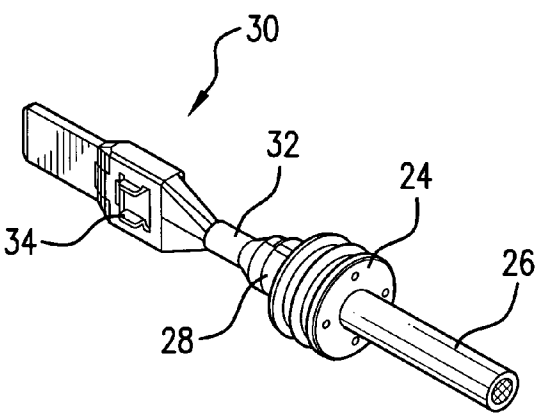
FIG. 2 PRIOR ART
FIG. 2 illustrates a prior art electrical terminal with a separate seal attached to an electrical wire behind a crimp joining the terminal to the wire.
Figure 1:
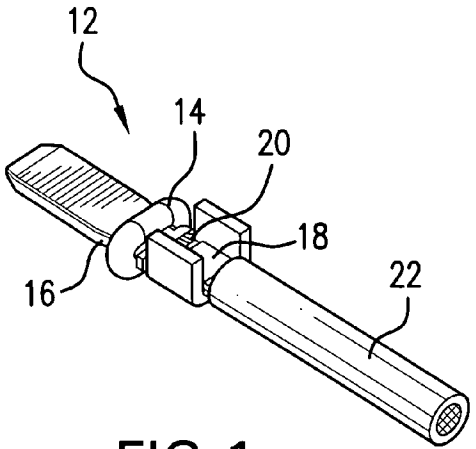
FIG. 1 PRIOR ART
FIG. 1 is a depiction of a prior art electrical terminal with a seal provided on a contact portion of the terminal.
Figure 3:
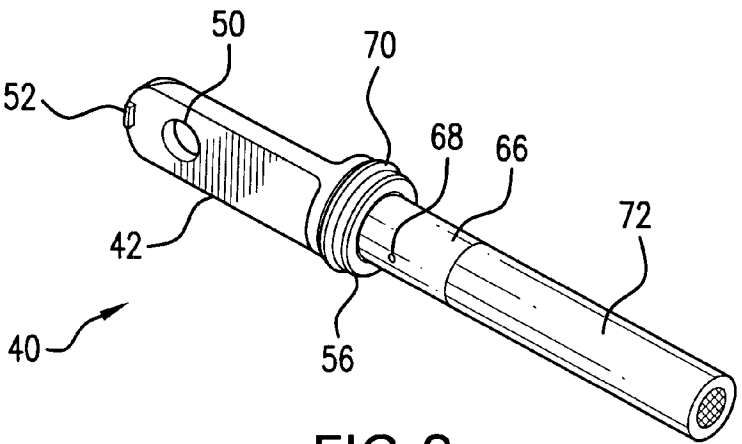
FIG. 3 is a perspective view of a sealed eyelet terminal according to the present invention.
Figure 5:
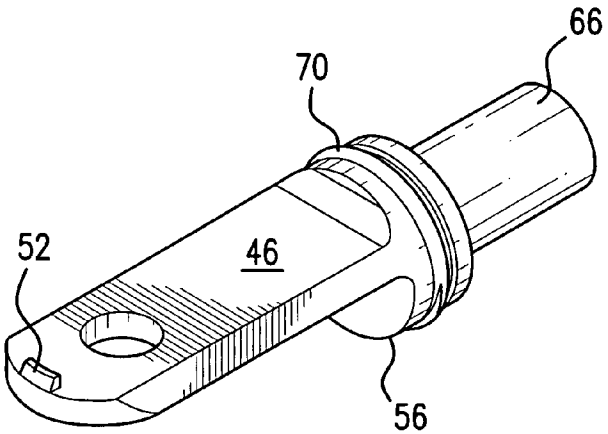
FIG. 5 is a view illustrating the underside, relative to FIG. 4, of the sealed eyelet terminal.
Figure 4:
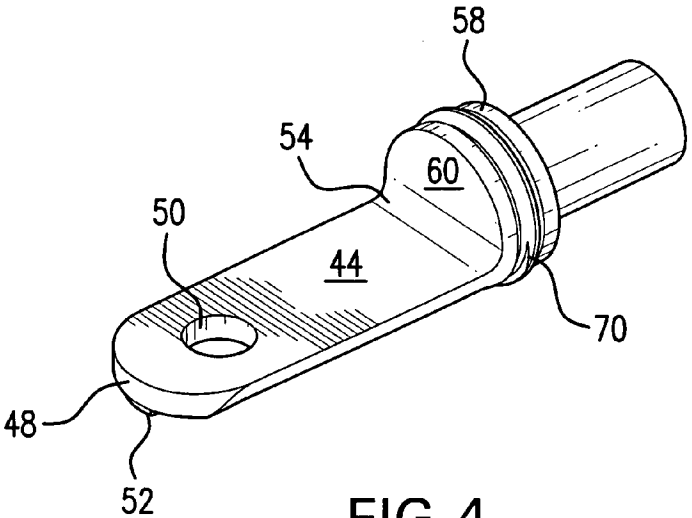
FIG. 4 is a top view, as oriented in the drawing, of the sealed eyelet terminal.
Figure 6:
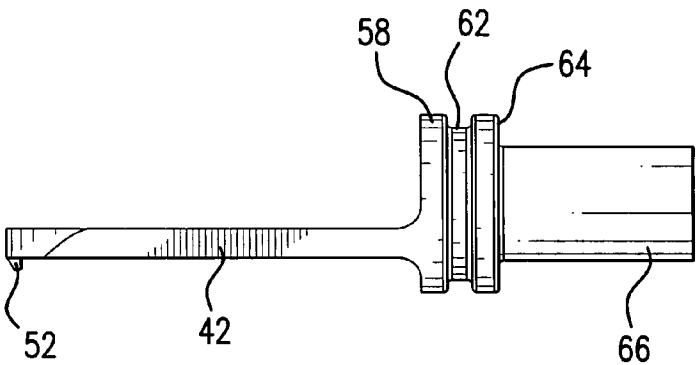
FIG. 6 is a side view of the eyelet terminal without the seal.

Referring now to FIGS. 3-6, an electrical terminal 40 according to the present invention has a substantially flat eyelet or contact section 42 for making electrical engagement with a mating element or component. As oriented in the FIGS. 4-6, the contact section 42 has an upper side 44 and an underside 46. The contact section 42 has a first, free end 48. An eyelet or aperture 50 adjacent the first end 48 extends through the contact section. A locking feature in the form of a hook-like projection 52 protrudes from the underside 46 of the contact section 42 at the first end 48. A second end 54 of the contact section 42 is integrally joined to an intermediate, cylindrical section 56. The cylindrical section 56 has an outer circumferential surface 58. The contact section 42 extends perpendicularly from a circular front stop or end face 60 of the cylindrical section 56 at an outer or lower region of the end face 60 as best illustrated in FIGS. 4-6. A groove 62 extends around the outer circumferential surface 58 in a center portion of the cylindrical section 56. An opposite or rear end face 64 of the cylindrical section 56 is integrally joined to a wire attachment or crimp section 66 of the terminal, and may provide a bushing seat as will be later explained. The crimp section 66 extends from a central region of the end face 64 and is tubular with a hollow interior. At least one air hole 68 extends through the crimp section 66.

The contact section 42, cylindrical section 56 and crimp section 66 are formed as one continuous piece from an electrically conductive material such as copper and plated with tin, silver or the like. The material is machined, for example turned on a lathe and then milled, into the proper shape. As shown in a cross-sectional view of the terminal in FIG. 8, the cylindrical section 56 of the terminal is solid or non-hollow. The groove 62 around the outer circumferential surface of the cylindrical section 56 is machined deep enough to at least partially receive and securely hold in place a high temperature, elastomeric o-ring seal 70. The material of the resilient seal 70 is chosen to withstand high temperatures and could be, for example, silicone or acrylic. The groove 62 retains the seal well enough that a separate retention feature is not needed on the terminal 40 or mating component. The seal could also be more permanently affixed within the groove by adhesive. The o-ring eliminates the need for a separate seal crimp. It may be manually applied on the cylindrical section 56 during an assembly process, or could be applied in an automated process.

The crimp section 66 electrically and mechanically attaches the terminal 40 to an insulation-stripped end of an electrical cable or wire 72 in a standard, compressive crimp process. Air trapped within the crimp section 66 during the crimping process can escape through the air holes 68. The seal 70 is positioned such that unwanted fluids or contaminants cannot seep into conductor strands within the crimp section 66 and thereby travel along an interior of the wire 72 to damage, for example, a power supply connection to the wire 72. The seal configuration of this invention could also be used to protect wire attachment means other than crimps.

Figure 7:
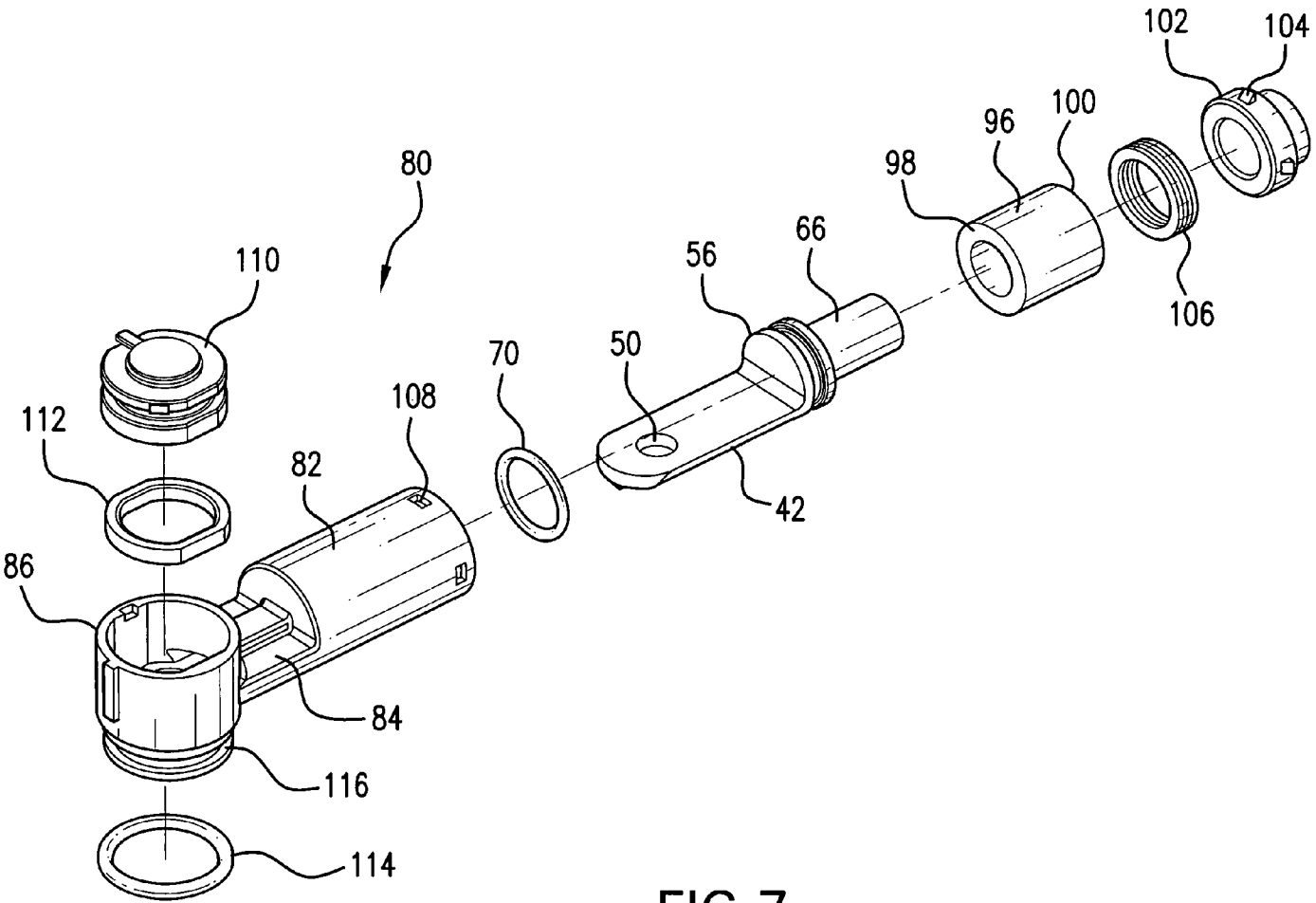
FIG. 7 is an exploded perspective view of the eyelet terminal and a connector assembly.
Figure 8:
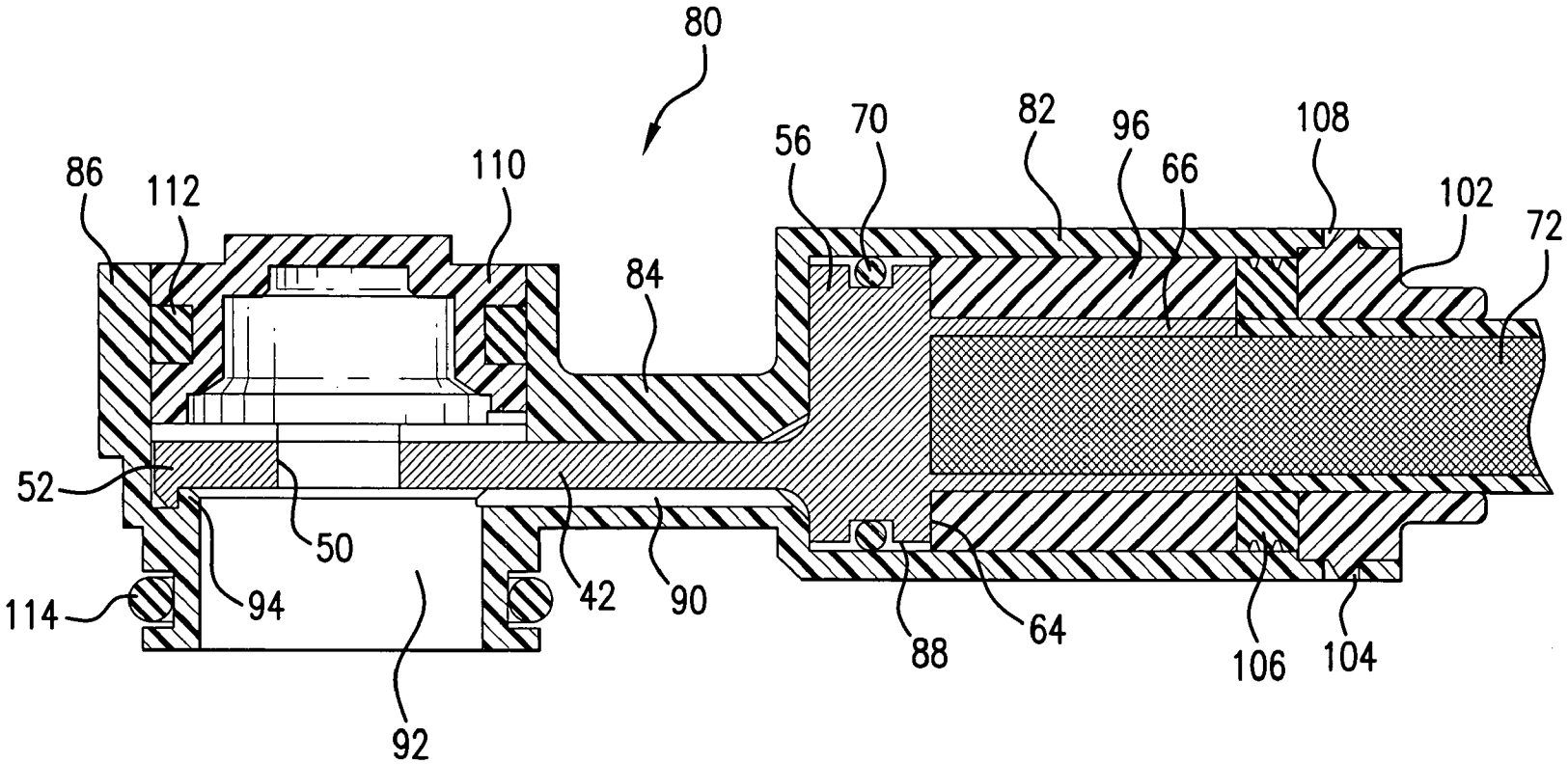
FIG. 8 is a cross-sectional side view of the sealed eyelet terminal mounted in the connector assembly.

The locking feature is machined at the end 48 of the terminal distal from the cylindrical section 56 to prevent the terminal from dislodging out of its corresponding connector housing. The locking feature may be the hook-like tab or projection 52 as shown or some other shape that prevents the terminal from being inadvertently removed or released from a connector housing. FIGS. 7 and 8 illustrate an example of a connector or connector housing 80 in which the terminal 40 would be advantageously employed. The connector or connector housing 80 could be used, for example, to provide current from a power supply connection to a vehicle transmission. The housing is molded from an electrically nonconductive or insulating plastic. It has a first, barrel-shaped part 82, a second, intermediate, relatively narrower and semi-rectangular part 84, and a third, drum-shaped part 86 oriented at a right angle to the first part 82. An interior cavity 88 within the first part 82 communicates with a passage 90 through the second part 84 that in turn joins a hollow interior 92 of the third part 86.

After the seal 70 is applied on the cylindrical section 56 of the terminal 40 and the crimp section 66 is secured to a stripped end of the insulated electrical wire 72, the terminal is inserted through the cavity 88, with the contact section 42 extending through the passage 90 into the hollow interior 92. The stop face 60 of the cylindrical section 56 prevents over-insertion of the terminal. The locking feature 52 on the contact section 42 snaps over a locking ridge 94 in the interior 92. An electrically non-conductive bushing 96 fits around the tubular crimp section 66. The bushing 96 has a first end 98 that abuts or seats against the end face 64 of the cylindrical section 56 and a second end 100. A rear holder 102 with locking tabs 104 on its outer surface fits into the barrel-shaped part 82 to sandwich a seal 106 between the second end 100 of the bushing 96 and the holder. The locking tabs 104 snap into locking apertures 108 on a perimeter of the barrel-shaped part 82. The bushing 96 thereby retains the seal 106 in the proper position. The bushing 96 also prevents shifting of the terminal 40 within the connector housing 80 in the event of a failure of the lock feature 52. The seal 106 seals around an outer insulation jacket of the wire 72 to prevent contaminants from reaching the crimp section 66 from the rear direction.

The eyelet 50 of the terminal 42 is aligned in a central location within the drum-shaped part 86. A bolt and nut assembly (not shown), for example, is used in combination with the eyelet 50 to secure the contact section 42 into electrical connection with a mating element extending into the interior 92 of the drum-shaped part 86. An electrically non-conductive cap 110 with an outer circumferential seal 112 fits into the drum-shaped part 86 over the eyelet and the contact section. The cap 110 protects and seals the bolt and nut assembly. Another seal 114 fits within a groove 116 on an outer surface of a lower portion of the drum-shaped part 86 to waterproof the connection with the transmission part. The seal 70 in the groove 62 on the outer circumferential surface 58 of the cylindrical section 56 of the terminal 40 prevents water or other contaminants, such as transmission fluid, from reaching the crimp section 66.

Figure 10:
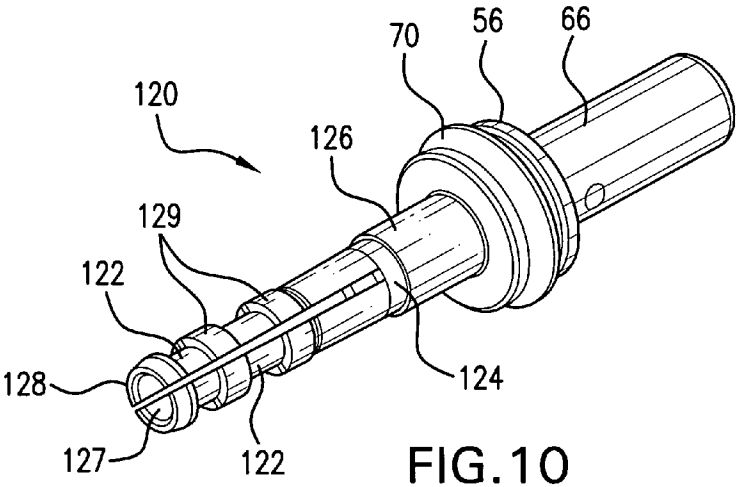
FIG. 10 is a perspective view of a female sealed electrical terminal according to the present invention.
Figure 9:
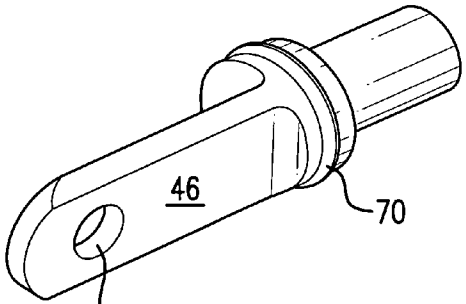
FIG. 9 is a perspective view of the sealed eyelet terminal without a lock feature.

FIG. 9 is meant to illustrate that the eyelet terminal may be formed and used without a locking feature if the environment does not require one. FIG. 10 shows a second, one-piece, female contact embodiment of the terminal. The cylindrical and crimp sections of the female terminal 120 are substantially identical to those on the terminal 40 and are represented by the same reference numbers. The substantially flat eyelet or contact section 42 is replaced by four, slightly spaced apart, quarter-tubular arms 122 extending from an annular collar 124 integrally joined to a solid base portion 126. The base portion 126 is in turn integral with the cylindrical section 56. The length of the base portion 126 could be set as needed for different connector sizes. Open interiors 127 of the arms 122 face each other, together forming a chamber for receiving a male terminal through an insertion end 128. A series of semi-circular annular rings 129 provide strength to the arms 122 without adding significant weight. Since the arms 122 are slightly spaced apart and cantilevered from the annular collar 124 of the contact section, there is some flexibility built into the design such that the arms are resiliently biased to clamp around the male terminal.

Figure 11:
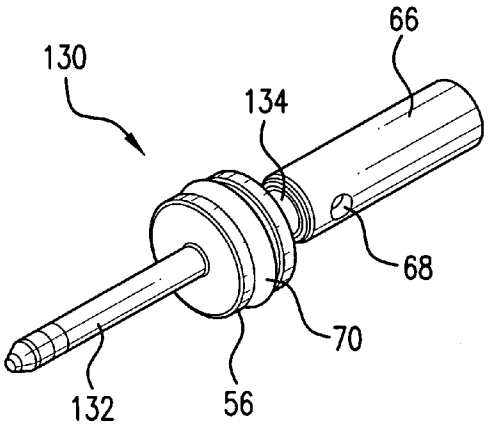
FIG. 11 is a perspective view of a male, sealed electrical terminal according to the present invention.

FIG. 11 illustrates a third embodiment of the invention, wherein the contact section is formed to create a male terminal 130 comprising a narrow rod-like contact or pin 132 for mating with a female terminal. The male terminal 130 could include an integral extension 134, smaller in outside diameter than the cylindrical section 56 and crimp section 66, to increase the length of the terminal for certain environments. The sealed male pin terminal 130 of the present invention could advantageously be used in combination with the sealed female terminal 120 of the present invention to provide a sealed connection with protected or waterproofed crimp sections 66 on each side of a connector assembly.

Figure 12:
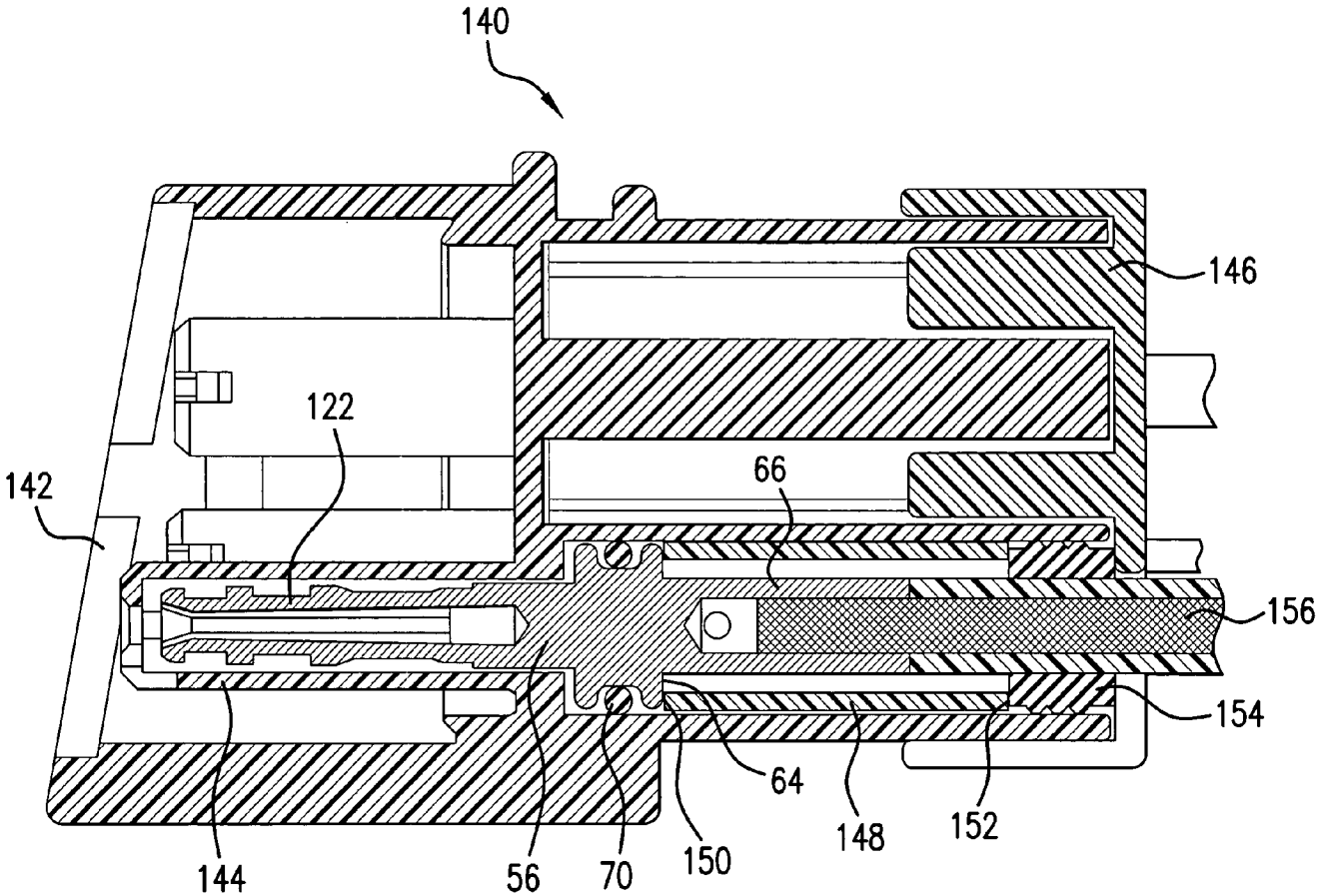
FIG. 12 is a cross-sectional side view of the female, sealed terminal mounted in a charge connector.

The electrical terminal 120 and 130 could, for example, be used in a high voltage charging connector 140 for an electric vehicle, as partially demonstrated in FIG. 12. Such connectors often use female terminals designed for use in high voltage connections on the power supplying side, so the terminal 120 is used in the example. The power supplying or charging connector 140 depicted has a mating end 142 having an inclined shape and providing access to an inner terminal accommodating chamber 144. The connector would include a rear holder 146 and a bushing 148. The bushing 148 has a first end 150 abutting against the rear end face 64 of the cylindrical section 56 of the terminal 120 and a second end 152. The second end 152 sandwiches an additional seal 154 against the rear holder 146 in position around a power supply wire 156 terminated by the terminal 120. This provides complete sealing in both directions for the crimp section 66 of the terminal. The male terminal 130 could be used in the power receiving connector (not shown), or the locations of the terminals 120 and 130 could be reversed, or the terminals 120 and 130 could be used with standard, mating electrical terminals. The seal 70 on the cylindrical section 56 of the terminal 120 prevents water and other contaminants from accessing the crimp section 66 through the mating end 142 of the charging connector and damaging the connection to the power supply.

Since minor changes and modifications varied to fit particular operating requirements and environments will be understood by those skilled in the art, this invention is not considered limited to the specific examples chosen for purposes of illustration. The invention is meant to include all changes and modifications which do not constitute a departure from the true spirit and scope of this invention as claimed in the following claims and as represented by reasonable equivalents to the claimed elements.

What is claimed is:

1. An electrical terminal comprising:

a contact section for electrically connecting with a mating element;

a crimp section for electrically and mechanically attaching the contact section to an electrical wire;

a non-hollow cylindrical section immediately between and integrally joined as one continuous piece with both the contact section and the crimp section, the cylindrical section having an outer circumferential groove;

a seal for receipt in the groove of the cylindrical section; and a lock feature formed on the contact section, the lock feature being a projection on an underside of a free end of the contact section distal from the cylindrical section.

2. The electrical terminal of claim 1 wherein the seal is permanently affixed within the groove.

3. The electrical terminal of claim 1 wherein the seal is an o-ring seal.

4. The electrical terminal of claim 1 wherein the crimp section is tubular with an interior for receiving the electrical wire.

5. The electrical terminal of claim 1 wherein the contact section is substantially flat.

6. The electrical terminal of claim 5 wherein the contact section further includes an eyelet extending through an end portion of the contact section distal from the cylindrical section.

7. The electrical terminal of claim 6 wherein the cylindrical section has an end face from which the contact section perpendicularly extends, the contact section being integrally joined to a lower region of the end face.

8. The electrical terminal of claim 1 wherein the contact section is in the shape of a male contact.

9. The electrical terminal of claim 8 further comprising an integral extension between the cylindrical section and the crimp section.

10. The electrical terminal of claim 1 wherein the contact section is in the shape of a female contact.

11. The electrical terminal of claim 10 wherein the female contact comprises four facing quarter-tubular arms for receiving and clamping a male contact element between them.

12. The electrical terminal of claim 11 wherein the arms extend from an annular collar joined to the cylindrical section.

13. The electrical terminal of claim 12 further comprising a base portion for the contact section between the annular collar and the cylindrical section.

14. An electrical terminal comprising:

an electrical contact section;

a connecting section for mechanically and electrically attaching the contact section to an electrical conductor; and an intermediate section between the contact section and the connecting section, the intermediate section being cylindrical, solid and having an outer surface with a groove extending around the outer surface, wherein the electrical contact section, connecting section and intermediate section are formed as one piece from an electrically conductive material; wherein the intermediate section comprises a rear end face facing the connecting section; and a connector housing for receiving the terminal, the housing including a bushing for fitting around the connecting section and abutting against the rear end face on the intermediate section.

15. The electrical terminal of claim 14 wherein the groove is sized and configured to partially receive and retain a seal.

16. The electrical terminal of claim 14 further comprising a circular stop face on the intermediate section overlooking the contact section.

17. The electrical terminal of claim 14 further comprising a holder that fits into the housing and sandwiches a seal between the holder and bushing.

* * * * *